United States Patent [19]

Stumpp

[11] 3,994,273

[45] Nov. 30, 1976

[54] FUEL INJECTION SYSTEM

[75] Inventor: Gerhard Stumpp, Stuttgart, Germany

[73] Assignee: Robert Bosch G.m.b.H., Stuttgart, Germany

[22] Filed: July 21, 1975

[21] Appl. No.: 597,912

[30] Foreign Application Priority Data

Aug. 3, 1974 Germany ..... 2437450

[52] U.S. Cl. ..... 123/139 AW; 123/139 AL; 123/139 AT

[51] Int. Cl.[2] ..... F02M 39/00

[58] Field of Search.. 123/139 AW, 119 R, 139 AT, 123/139 AK, 139 AF, 139 AL

[56] References Cited

UNITED STATES PATENTS

| | | | |
|---|---|---|---|
| 3,867,917 | 2/1975 | Zeyns et al. | 123/119 R |
| 3,896,778 | 7/1975 | Zeyns et al. | 123/139 AW |
| 3,942,497 | 3/1976 | Schwartz | 123/139 AW |
| 3,949,713 | 4/1976 | Rivere | 123/140 FG X |

*Primary Examiner*—Charles J. Myhre
*Assistant Examiner*—Tony M. Argenbright
*Attorney, Agent, or Firm*—Edwin E. Greigg

[57] ABSTRACT

A fuel injection system for externally ignited internal combustion engines in which fuel is individually metered to each injection valve through mutually displaceable metering valves. A diaphragm-type pressure valve is disposed between each metering valve and each injection valve. One of these valves is a differential pressure valve, which maintains a constant pressure difference across the metering valve to which it is connected. The remainder of these diaphragm valves are pressure equalizing valves, controlled by the output pressure of the differential pressure valve to maintain the same constant pressure difference across each of the remaining metering valves. The injection valve supplied with fuel by the differential pressure valve, opens at a higher fuel pressure than the remaining injection valves, thus also serving as a pressure valve. Additionally, the pressure setting of the differential pressure valve can be changed, when required, in dependence on a particular engine parameter by other control means.

5 Claims, 3 Drawing Figures

FUEL INJECTION SYSTEM

CROSS-REFERENCE TO RELATED APPLICATION

The present application discloses subject matter in common with application Ser. No. 518,988 now U.S. Pat. No. 3,942,497, filed on Oct. 29, 1974 by Reinhard Schwartz. Both applications are assigned to the same assignee.

BACKGROUND OF THE INVENTION

The present invention relates to a fuel injection system for an externally ignited internal combustion engine, and more particularly to such a system including fuel injection valves, and a fuel distributing unit with fuel metering valves which are jointly changeable for the purpose of varying their flow passage cross-section to regulate the quantity of fuel flowing to the fuel injection valves. The fuel metering process is effected with a constant pressure difference. Disposed in each fuel flow path downstream of the fuel metering valves is a valve, whose flow passage cross-section can be changed by means of a flexible member. The flexible member for each valve separates two chambers in the valve, with the pressure in the first chamber of each valve being the fuel pressure of the fuel downstream of its respective metering valve. At least one valve is in the form of a pressure equalizing valve and at least one valve is in the form of a differential pressure control valve. In the second chamber of the differential pressure control valve there prevails the fuel pressure upstream of the metering valves and the first chamber of the differential pressure control valve communicates with the second chamber of each pressure equalizing valve.

Fuel injection systems of this type are designed to produce a corresponding variation in the flow passage cross section of the downstream valves in response to the regulated fuel quantity acting on the metering valves and corresponding to the operating conditions of the internal combustion engine; and, also with the aid of as constant a pressure drop as possible at this flow passage cross section, to achieve constant and accurate fuel metering corresponding to the free cross section of the downstream valves irrespective of the pressures upstream and downstream of the metering location.

In the case of known fuel injection systems of this type, the fuel for the individual cylinders of the internal combustion engine is metered in common at various control slots by means of a control edge of a control slide. The metering operation takes place with a pressure difference which is kept constant but which is electromagnetically variable by means of a differential pressure control valve as a function of the engine parameters. The construction costs for such a system are relatively high.

OBJECTS AND SUMMARY OF THE INVENTION

It is, therefore an object of the present invention to provide the existing state-of-the-art with an improved fuel injection system of the type discussed above.

It is another object of the present invention to provide the existing state-of-the-art with a fuel injection system of the type discussed above which can be constructed at a very low cost while fulfilling the requirements placed on fuel injection systems of this type.

It is still another object of the present invention to use a single differential pressure control valve, to supply fuel to one of the injection valves, and, in conjunction with one or more pressure equalizing valves supplying fuel to the remainder of the injection valves, to control the pressure difference across each metering valve, thus eliminating the need for a separate control pressure circuit.

These and other objects of the present invention are achieved in that the pressure in the fuel injection system is regulatable by means of an injection valve disposed in an injection conduit downstream of the first chamber of the differential pressure control valve.

According to an advantageous feature of the present invention the injection valves downstream of the first chambers of the pressure equalizing valves open with a lower fuel pressure in the injection conduits than the injection valve in the injection conduit downstream of the first chamber of the differential pressure control valve.

Another advantageous feature of the present invention is that the pressure equalizing valve is in the form of a flat seat valve comprising a diaphragm as the movable valve member.

Another advantageous feature of the present invention is that the differential pressure control valve is in the form of a flat seat valve comprising a diaphragm as the movable valve member, which is biased in the closing direction by a spring having a flat characteristic.

Another advantageous feature of the present invention consists in that the pressure difference at the metering valve is variable by means of the differential pressure control valve as a function of the engine parameters.

Other objects, features and advantages of the present invention will be made apparent in the course of the following detailed description of a preferred embodiment thereof provided with reference to the accompanying drawings.

DESCRIPTION OF THE PREFERRED EMBODIMENT

Figure 1:
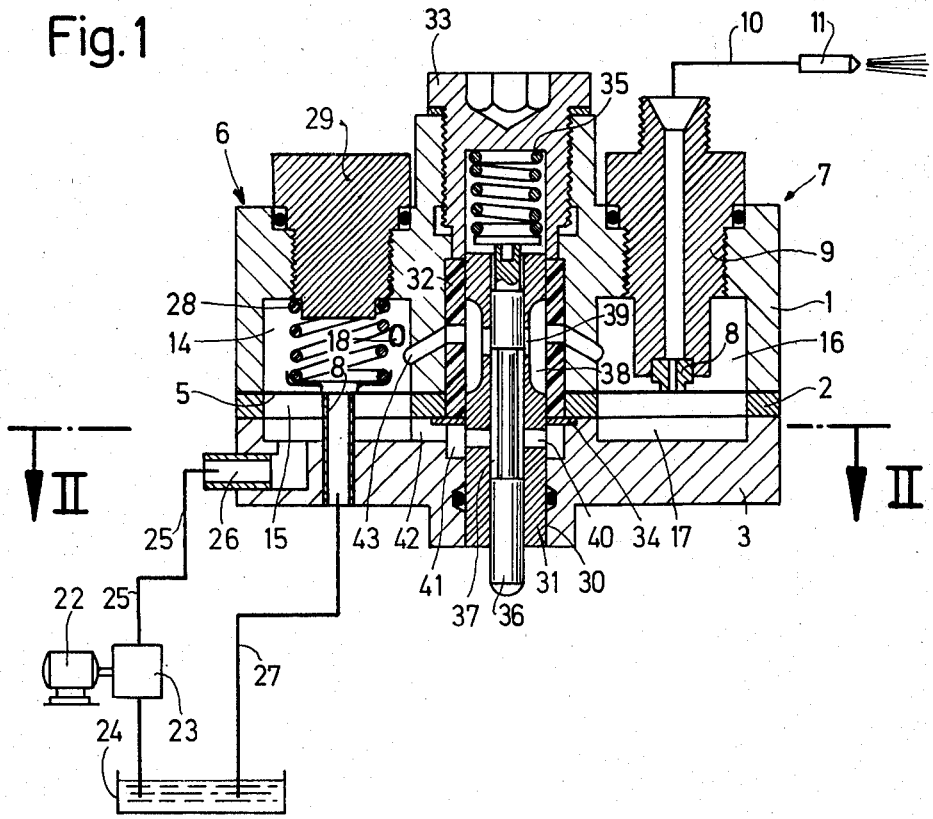
FIG. 1 is an axial sectional view of an exemplary embodiment of a fuel injection system according to the present invention.
Figure 2:
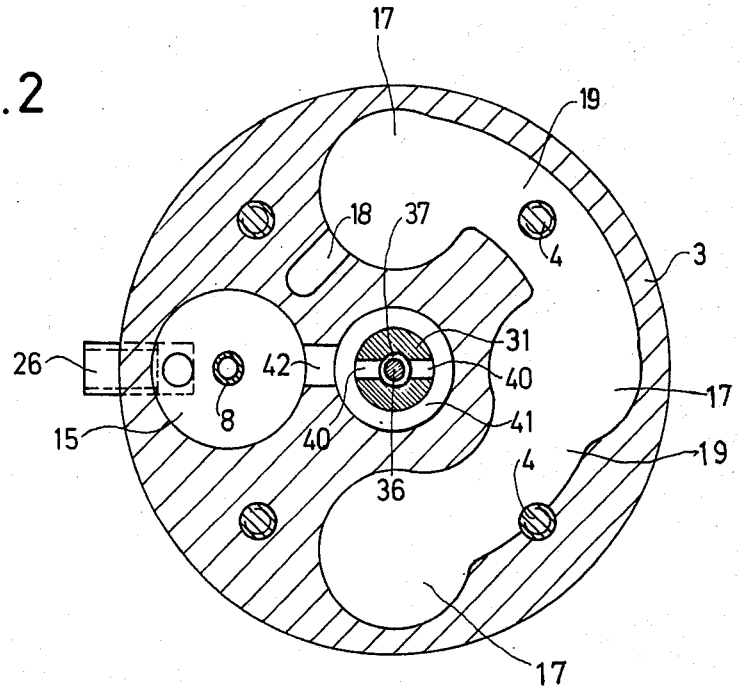
FIG. 2 is a cross-sectional view along the line II—II of FIG. 1.
Figure 3:
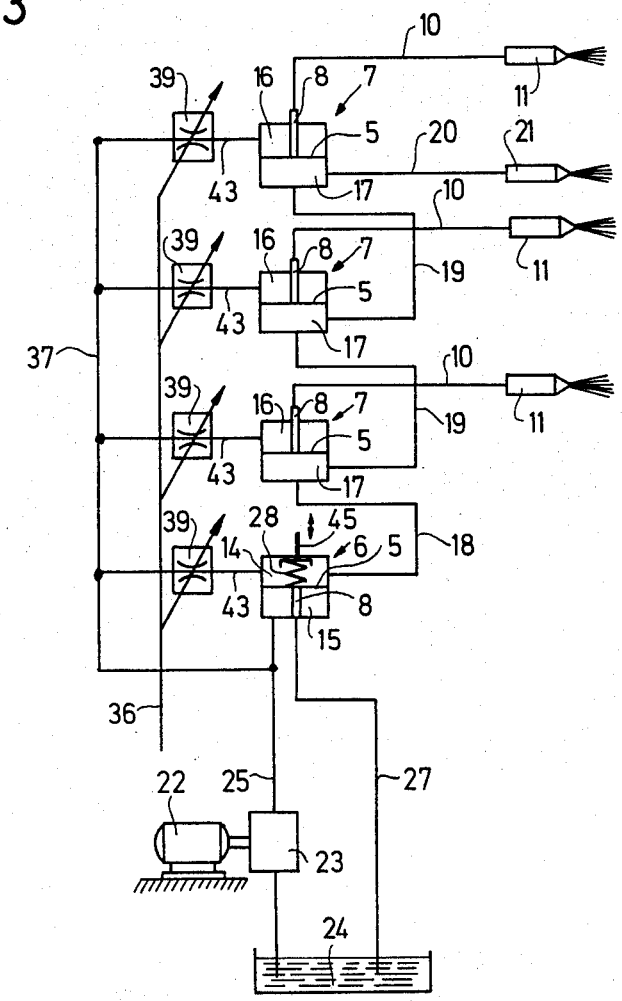
FIG. 3 is a schematic representation of the fuel injection system according to the present invention.

The exemplary embodiment of the fuel injection system illustrated in FIGS. 1, 2 and 3, is for a four-cylinder internal combustion engine. The system includes a fuel metering and distributing unit having a housing 1, an intermediate plate 2 and a bottom cover 3 which are axially clamped together by means of bolts 4. Clamped between the housing 1 and the intermediate plate 2 is a diaphragm 5. The diaphragm 5 serves to divide axial bores 14, 15 and 16, 17, uniformly distributed about the longitudinal axis of the housing, into chambers 14, 15 and 16, 17. The diaphragm 5 also serves as the diaphragm for diaphragm valves 6 and 7. Because the exemplary embodiment illustrated relates to a fuel metering and distributing system for a four-cylinder internal combustion engine, there are four diaphragm valves of which one is a differential pressure control valve 6 and the other three valves are pressure equalizing valves 7. In each of these valves the diaphragm 5 forms a flat seat valve with a stationary valve seat 8.

The valve seats 8 of the pressure equalizing valves 7 are mounted to valve seat carriers 9 which are threadedly engaged to the housing 1 and which serve as connecting members for injection conduits 10 leading to fuel injection valves 11, while the valve seat 8 of the differential pressure control valve 6 is mounted directly to the bottom cover 3. On the one hand, the diaphragm 5 serves firstly to divide a first chamber 14 from a second chamber 15 of the differential pressure control valve 6 and, on the other hand, to divide the first chamber 16 from the second chamber 17 of the pressure equalizing valves 7. A channel 18 leads from the first chamber 14 of the differential pressure control valve 6 to the second chamber 17 of a pressure equalizing valve 7. The second chambers 17 of the pressure equalizing valves 7 are interconnected by means of an annular channel 19. The annular channel 19 discharges into an injection conduit 20 which leads to an injection valve 21.

Fuel is supplied from a fuel tank 24 by means of a pump 23 driven by an electric motor 22. The fuel passes through a conduit 25 and a connecting member 26 into the second chamber 15 of the differential pressure control valve 6. When the differential pressure control valve 6 is open the fuel can flow to a greater or lesser extent back to the fuel tank 24 via the valve seat 8 and a conduit 27.

A helical spring 28 disposed in the first chamber 14 of the differential pressure control valve 6 biases the membrane 5 in the closing direction so that the differential pressure control valve 6 is closed when not in operation.

An axial bore 30 formed in the housing 1, the intermediate plate 2 and the bottom cover 3 of the fuel distributing unit has a bushing 31 mounted therein. The bushing 31 is prevented from being axially displaced and rotated by means of an elastic sealing sleeve 32 which may be made of rubber, and which is also mounted within the bore 30. To achieve this, the sealing sleeve 32 is axially compressed by a plug 33 against a disk 34 disposed between the bottom cover 3 and the intermediate plate 2. This measure also prevents any fuel from leaking between the bushing 31 and the housing 1 and the intermediate plate 2.

A control slide 36 is provided which is axially slidable within the guide bushing 31 against the force of a spring 35. The control slide 36 has formed therein an annular groove 37. In place of the spring 35, the restoring force exerted on the control slide 36 could also be produced by a pressurized fluid exerting a force on the plunger. The pressurized fluid would be controlled by a hydraulic pressure control system (not shown). The guide bushing 31 has longitudinal grooves 38 which communicate with the inner bore of the bushing 31 through exactly identical, axially parallel, longitudinal slots 39 (control slots) or control bores. Thus, depending on the position of the control slide 36, the annular groove 37 opens or uncovers a section of the control slots 39 of greater or lesser length. The guide bushing 31 also contains radial bores 40 which provide constant communication between the annular groove 37 and an annular channel 41 provided in the bottom cover 3. The annular channel 41 communicates with the second chamber 15 of the differential pressure control valve 6 by means of a channel 42. The longitudinal grooves 38 of the guide bushing 31 communicate with the first chamber 14 of the differential pressure control valve 6 and with the first chambers 16 of the pressure equalizing valves 7 by means of the channels 43. A longitudinal groove 38 and an associated control slot 39 is provided for each of the valves 6 and 7. The first chambers 14 or 16 are thereby separated from one another.

The method of operation of the fuel injection system described is as follows:

The fuel supplied by the fuel pump 23 is delivered via the conduit 25 and the connecting member 26 into the second chamber 15 of the differential pressure control valve 6. From there it flows via the channel 42, the annular channel 41, and radial bores 40 into the annular groove 37 of the control slide 36. The control slide 36 can be displaced in an axial direction, for example, by means of an air measuring member (not shown) disposed in the suction tube of the internal combustion engine, so that the annular groove 37 opens the control slots 39 to a greater or lesser extent. The fuel is metered by the control slots 39 and flows from the annular groove 37 into the longitudinal grooves 38. From there it flows through the channels 43 into the first chamber 14 of the differential pressure valve 6 and into the first chambers 16 of the pressure equalizing valves 7. From the first chamber 14 the fuel flows through the channel 18 into the second chambers 17 of the pressure equalizing valves 7 because of the annular channel 19.

The rigidity of the diaphragm 5 and the force of the spring 28 of the differential pressure control valve 6 are so chosen that when there is a variation in the pressure drop between the first chamber 14 and the second chamber 15, the flow passage cross-section between the diaphragm 5 and the valve seat 8 changes until this pressure drop is restored. In the case of the flat seat valve 6, which is illustrated, this pressure drop can be restored in an extremely short time as there is a marked variation in the flow passage cross-section with only minimal lifting of the diaphragm 5. On the other hand, the spring force is only minimally varied as a result of this minor or slight lifting of the diaphragm 5, and thus the control system can operate extremely accurately. In other words, the pressure drop remains virtually constant irrespective of the fuel quantities flowing through the system.

The throttling action on the fuel at the control slots 39 is approximately uniform and thus the fuel pressure in the first chamber 14 of the differential pressure control valve 6 and the first chambers 16 of the pressure equalizing valves 7 is approximately uniform. By virtue of the fact that the first chamber 14 of the differential pressure control valve 6 communicates with the second chambers 17 of the pressure equalizing valves 7, in the regulated state, through the channel 18, the fuel pressure in the second chambers 17 is generally equal to that of the first chambers 16. The use of pressure equalizing valves offers the advantage that in order to obtain a desired pressure difference at the metering valves 37, 39, it is only necessary to adjust the spring 28 of the differential pressure control valve 6. There is no need to adjust the individual pressure equalizing valves 7 in a similar manner. The advantage offered by the present system over the known fuel injection systems of this type is that it eliminates the separate control pressure circuit and control pressure valve.

According to the present invention the pressure in the fuel injection system is regulated by the injection valve 21 disposed downstream of the first chamber 14 of the differential pressure control valve 6. To this end, the injection valves 11 downstream of the first chambers 16 of the pressure equalizing valves 7 are regulated in such a way that they open with a lower fuel pressure in the injection conduits 10 than the injection valve 21 disposed downstream of the first chamber 14 of the differential pressure valve 6. The advantage offered by designing the injection valve 21 as a pressure valve (Systemdruck) is that it is not necessary to provide a separate pressure valve. Thus, the injection valve 21 opens, for example, at a fuel pressure of 4.5 bar. With a pressure drop of 0.1 bar at the control slots 39 and a pressure of 1.2 bar at the valve seats 8, the opening pressure for the injection valves 11 is approximately 3.3 bar.

FIG. 3 illustrates an arrangement whereby it is possible to obtain a variation in the differential pressure at the metering valves 37, 39, by varying the force of the spring 28 by means of a control element 45 at the differential pressure control valve 6. It may be necessary to vary the pressure difference at the metering valves 37, 39 in this way in order to adapt the fuel-air mixture to the operating conditions of the internal combustion engine. Accordingly, it is necessary for a differential pressure variation of this nature to be effected as a function of the engine parameters. However, this does not mean that the differential pressure at the metering valves 37, 39 is to be varied constantly. This operation is only intended to change the differential pressure to a different value and it is then kept constant at this value. The force of the spring 28 in the differential pressure control valve 6 can be varied, for example, by actuating the actuator 45 by means of an electromagnetic system (not shown) or a screw 29. An expedient method of regulating the pressure difference at the metering valves 37, 39 is by means of the oxygen content in the exhaust gas of the internal combustion engine. A so-called oxygen probe (not shown) which is disposed in the exhaust gas conduit of the internal combustion engine and which controls the electromagnetic system by way of an electronic circuit, may be used for this purpose. As a result of varying the pressure difference at the differential pressure control valve 6, the fuel pressure in the first and second chambers of the pressure equalizing valves 7 is varied and, accordingly, there is a variation in the pressure difference at the metering valves 37, 39. Such so-called oxygen probe, electronic circuit, electromagnetic system and actuator 45 are known, for example, from U.S. Pat. Nos. 3,738,341; 3,745,768; 3,759,232; 3,782,317; 3,796,200; and 3,874,171.

What is claimed is:

1. In a fuel injection system for externally ignited internal combustion engines, including:

a. a plurality of fuel injection valves equal in number to the number of engine cylinders;

b. a fuel distributing unit having a plurality of fuel metering valves equal in number to the plurality of fuel injection valves;

c. a plurality of pressure valves equal in number to the plurality of fuel injection valves, each of said pressure valves including means producing a defined space, and a flexible member which divides the defined space into first and second chambers, with at least one of said pressure valves being embodied as a pressure equalizing valve and at least one of said pressure valves being embodied as a differential pressure control valve, and with the flow cross section of each pressure valve being changeable by its flexible member;

d. means connecting each of said pressure valves to a respective one of said fuel metering valves, with the pressure in the first chamber of each pressure valve being the fuel pressure prevailing downstream of its respective fuel metering valve, said prevailing pressure acting on the flexible member, and with the pressure in the second chamber of the differential pressure control valve being the pressure prevailing upsteam of the fuel metering valves;

e. further means connecting the first chamber of the differential pressure control valve with the second chamber of the at least one pressure equalizing valve; and f. still further means connecting each of the fuel injection valves to at least one of the pressure valves, wherein:

i. the metering valves are mutually displaceable for varying their flow passage cross section to thereby regulate the quantity of fuel flowing to the injection valves;

ii. fuel metering occurs at a constant pressure difference;

iii. one of the injection valves is connected by said still further means downstream of the first chamber of the differential pressure control valve, and serves thereby to regulate the pressure of the fuel injection system.

2. The fuel injection system as defined in claim 1, wherein the remaining injection valves are connected by said still further means to respective ones of the pressure equalizing valves downstream of the first chambers thereof, and wherein the remaining injection valves open with a lower pressure than said one of the injection valves.

3. The fuel injection system as defined in claim 1, wherein the pressure equalizing valve is embodied as a flat seat valve whose flexible member serves as the movable valve member.

4. The fuel injection system as defined in claim 1, further including a closing spring operatively associated with the differential pressure control valve, said closing spring having a flat characteristic, and wherein the differential pressure control valve is embodied as a flat seat valve whose flexible member serves as the movable valve member which is biased in the closing direction by the closing spring.

5. The fuel injection system as defined in claim 1, wherein the pressure difference at the metering valves is variable as a function of engine parameters by means of the differential pressure control valve.

* * * * *